US006505653B1

(12) United States Patent
Tholander

(10) Patent No.: US 6,505,653 B1
(45) Date of Patent: Jan. 14, 2003

(54) DEVICE AND METHOD FOR VARIABLY BRAKING A RUNNING YARD

(75) Inventor: Lars Helge Gottfrid Tholander, Haverdal (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/914,100

(22) PCT Filed: Feb. 23, 2000

(86) PCT No.: PCT/EP00/01492

§ 371 (c)(1),
(2), (4) Date: Jan. 15, 2002

(87) PCT Pub. No.: WO00/50326

PCT Pub. Date: Aug. 31, 2000

(30) Foreign Application Priority Data

Feb. 23, 1999 (SE) ..... 9900665

(51) Int. Cl.[7] ..... D03D 47/34
(52) U.S. Cl. ..... 139/450; 242/149
(58) Field of Search ..... 242/149; 139/450, 139/194, 485, 453

(56) References Cited

U.S. PATENT DOCUMENTS 5,179,980 A * 1/1993 Hubner et al. ..... 112/255
5,305,966 A 4/1994 Motta
5,363,883 A * 11/1994 Weidmann ..... 139/450
5,476,122 A * 12/1995 Schuster et al. ..... 139/194
5,492,286 A 2/1996 Motta
6,328,081 B1 * 12/2001 Gotti et al. ..... 139/450

FOREIGN PATENT DOCUMENTS

EP 0 524 429 1/1993
EP 0 597 239 5/1994

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

A device for the selective braking of a running yarn including a controlled yarn brake having at least two brake elements between which the yarn runs, which brake elements can be elastically pressed against each other with an adjustable force that determines the braking effect. The device also includes a first actuator for the temporary nullification of the braking effect, a control device to which the first actuator is connected, and a device for adjusting the brake force. The adjustment device includes a second actuator, which is also connected to a control device.

18 Claims, 2 Drawing Sheets

DEVICE AND METHOD FOR VARIABLY BRAKING A RUNNING YARD

FIELD OF THE INVENTION

The invention relates to a device and method for variably braking a running yarn in a weaving machine.

BACKGROUND OF THE INVENTION

A controlled yarn brake expediently is employed on a rapier weaving machine or a projectile weaving machine to produce a predetermined yarn tension profile in the yarn inserted into the weaving shed, which yarn tension profile is important for an optimum insertion cycle. Said yarn tension profile varies during the insertion cycle. In a rapier weaving machine it is e.g. of advantage to first brake stronger at the start of the insertion, to reduce or to nullify the braking effect during the subsequent acceleration phase of the bringer gripper, to again brake stronger during the transition phase from the bringer gripper to the taker gripper, then to reduce or nullify the braking effect at least for the acceleration phase of the taker gripper, and finally to brake again stronger in the end phase of the insertion until the inserted yarn is released by the taker gripper.

A controlled yarn brake known from EP-A-0 524 429 either does not brake at all or brakes with a single value of the braking force as adjusted at an adjustment device. The braking force can be selected manually at the adjustment device, however, due to the short time of an insertion cycle a further variation of that braking force is impossible during the same cycle. Since the braking force is identical for all operation phases it has to be a compromise such that the braking effect might be too weak for one operation phase, but may be too strong for another one. It is important to brake the yarn during differing operation phases of an insertion cycle with a varying braking effect.

It is known from practice to vary the braking effect of a controlled yarn brake by an actuator, e.g. by means of a rapidly responding stepper motor, in order to fulfill the requirement of differing braking effects for different operation phases of an insertion cycle. Due to the considerably short duration of an insertion cycle and the function depending inertia of the actuator, a relatively long period of time may elapse before the braking effect actually is nullified or activated or the respective adjusted force is fully active. Frequently, an undesirable residual braking effect remains even after nullifying the braking effect or the desired braking effect is not reached at the right point in time after actuating the braking effect. Generally, either too much braking power is imparted onto the yarn, or the actual braking effect as achieved at predetermined points in time or predetermined angle values of the rotation of the main shaft of the weaving machine is too weak.

It is an object of the invention to provide a device which is structurally simple and allows, during each insertion cycle, an optimally timed yarn tension profile to be achieved, and to provide a method by which an optimum yarn tension profile can be achieved for each insertion cycle.

This object can be achieved by providing a device for variably braking the running yarn which has two opposed braking elements, a first actuator for temporarily nullifying the braking effect, a control device connected to the first actuator, and an adjustment device for adjusting the force of the braking elements and actuable by a second actuator when the braking effect is nullified by the first actuator, wherein the second actuator is also connected with a control device.

The second actuator in the device varies the force decisive for the braking effect exclusively when the braking effect is nullified. Hence, the required braking effect is achieved exactly at the point in time or at the angle position of the main shaft of the weaving machine at which then the first actuator rapidly activates the braking effect. Since the time period between operation phases with activated braking effects is used to vary the force, and since the first actuator is capable of activating or nullifying the braking effect extremely rapidly, an optimum tension profile of the yarn can be achieved. This results from the fact that the first and second actuators divide the two tasks of activating or nullifying the braking effect and varying the force.

In view of the method it is of importance to use only operation phases to vary the force, during which operation phases the braking effect is completely nullified. This avoids a disadvantageous or delayed variation of the force during a subsequent operation phase for which the full braking effect is required.

Expediently, a second actuator of an electric, an electromagnetic, piezo-electric, electro-mechanic, pneumatic or hydraulic kind is used. Said actuator uses the time periods of the nullified braking effect to vary the force. To the contrary, the first actuator is only responsible for rapidly activating and nullifying (switching on and off only) the braking effect.

In preferred embodiment, both actuators are connected to a common control device. Said control device is adapted to control the second actuator exclusively when the first actuator has already nullified the braking effect.

It is of a particular advantage to use the second actuator in a so-called window-lamella-yarn brake to vary the contact force of the spring lamella co-operating with the counterstay bolt. The bolt has the window which is used to nullify the braking effect. The second actuator can be controlled in a simple way, because the predetermined rotational positions of the counterstay bolt or the first actuator are known precisely when it nullifies or activates the braking effect. A counterstay bolt can have only one circumferential window or even may have several circumferential windows. Said counterstay bolt then co-acts with the first actuator which either rotates back and forth in consecutive steps with one sense of rotation only.

Alternatively, the second actuator can be used to vary the force in controlled band brakes or disk brakes when the braking effect is nullified. A prerequisite is, however, a first actuator being fast enough to activate and nullify the braking effect rapidly.

The spring lamella of the window-lamella-yarn brake may be provided at a rotationally supported holder, the rotational position of which determines (with the inherent force of the spring lamella) the braking force. The second actuator forms a rotational drive for the holder. In this case the second actuator ought to be designed such that it automatically maintains the rotational position corresponding with predetermined forces.

In the control device, different rotational positions for the holder may be stored such that they can be established selectively via the second actuator. Said differing rotational positions represent the different forces of the braking effects.

Alternatively, the control device may contain a logical actuation inhibition system hindering the second actuator to vary the force until the braking effect has been nullified by the first actuator.

In another alternative embodiment, the second actuator may be adjusted back and forth between at least two position representing predetermined values of or a predetermined ratio between the values of the force. Nevertheless, said predetermined values of or the ratio between said values may be varied at the control side.

Expediently, the adjusting device for the force additionally is provided with a manual adjuster. In this case, the force also can be varied manually as in case of conventional window-spring lamella-yarn brakes, but even during an insertion cycle.

Expediently, the second actuator is a switching magnet, a rotary solenoid, a permanent magnet motor, a stepper motor, a LAT electro-motor (low angle turn electro-motor) or a hydraulic or pneumatic motor. Such types of actuators are sufficiently reliable as the second actuator may have a slower response behaviour than the first actuator, because it can use the nullified braking effect time periods during an insertion cycle to vary the force. The force variation, in practice, is typically relatively small.

Provided that the control device comprises a microprocessor, the force determining the braking effect even can be varied steplessly via the second actuator.

BRIEF DESCRIPTION OF THE DRAWINGS

Embodiments of the invention are explained by means of the drawings, in which.

DETAILED DESCRIPTION

Figure 1:
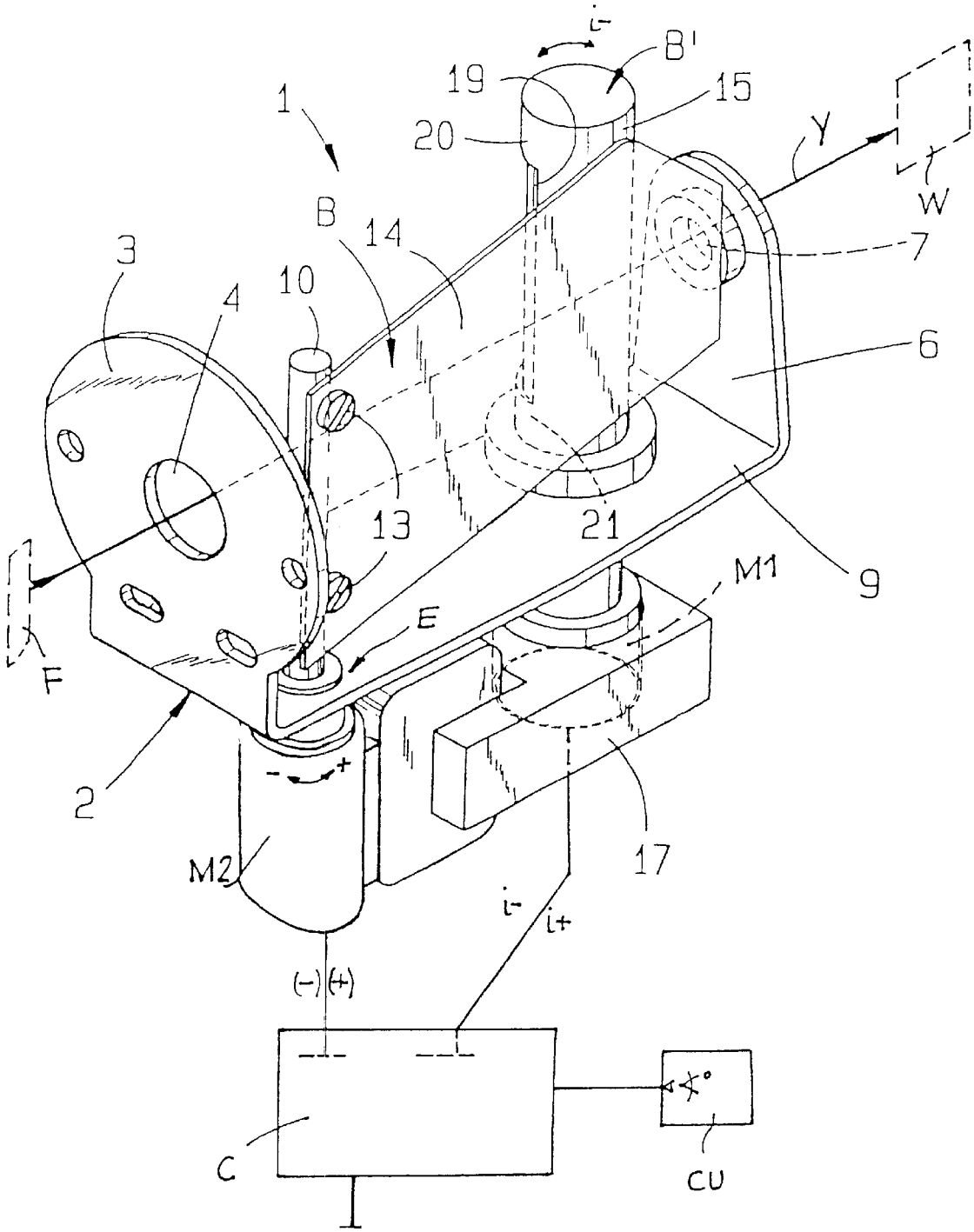
FIG. 1 is a perspective view of a controlled yarn brake in an operation position with an activated braking effect.
Figure 2:
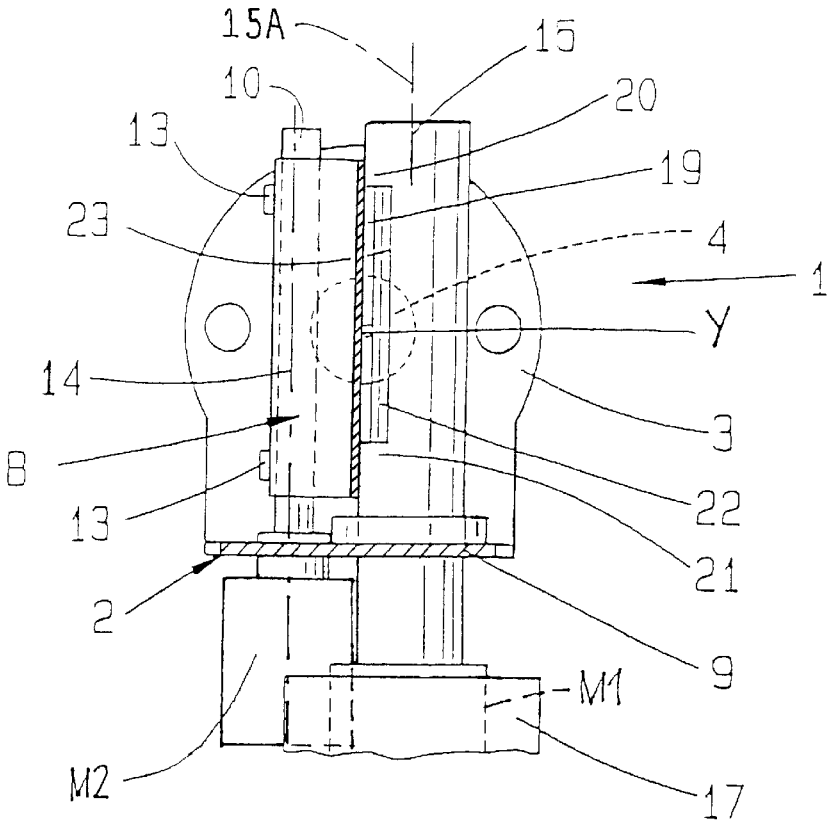
FIG. 2 is a sectional view of FIG. 1 in an operation position with a nullified braking effect and during adjustment of the force which determines the braking effect.

In FIGS. 1 and 2, a controlled yarn brake 1 is shown which includes a U-shaped carrier 2 having one leg 3 defining an entrance opening 4 for a yarn Y. Another leg 6 is provided which has a withdrawal eyelet 7 aligned with opening 4. Preferably, yarn brake 1 is located downstream of a yarn feeding device F which is only shown in dotted lines and upstream of a weaving machine W consuming the yarn Y. Weaving machine W preferably is a gripper, rapier or projectile weaving machine.

A bottom 9 of carrier 2 supports a thorn-like holder 10 in the vicinity of leg 3. Holder 10 is supported rotatably. Its rotational position is adjustable by an adjustment device E. In the embodiment shown the adjustment device E comprises a second actuator M2 which defines a rotational drive and positioning means for holder 10 and either is secured to carrier 2 or to a holder 17. Optionally, the adjustment device E may be equipped additionally with a manual adjuster (not shown) allowing either manual rotation of holder 10 relative to the second actuator M2 or manual adjustment of the second actuator M2 together with holder 10 relative to carrier 2.

One end of a spring lamella 14 made from spring material is secured by screws 13 to holder 10. Said end of spring lamella 14 instead could be captured within holder 10 having a longitudinal slit. An end portion of spring lamella 14 pointing towards withdrawal eyelet 7 rests against a counterstay bolt 15. Counterstay bolt 15 is rotatably provided in carrier 2 and extends about parallel to holder 10. Spring lamella 14 forms a first braking element B, while counterstay bolt 15 is a second braking element B'. The spring lamella bears with predetermined force resiliently on the circumference of counterstay bolt 15. Said force can be adjusted by means of the second actuator M2 and/or, if provided, by means of the already mentioned manual adjuster of adjusting device E. The yarn Y is running along a predetermined yarn path between spring lamella 14 and counterstay bolt 15. The end portion of spring lamella 14 pointing towards withdrawal eyelet 7 expediently is bent away such that the yarn Y is braked in the yarn brake 1 by a clamping action and essentially only in the contact region between the spring lamella 14 and the counterstay bolt 15.

Counterstay bolt 15 is actively connected with a first actuator M1 seated in holder 17. First actuator M1 e.g. is a permanent magnet motor which can be rotated in steps in one sense of rotation or which can be rotated back and forth between two predetermined rotational positions. The first actuator M1 is a very fast responding rotary drive for the counterstay bolt 15 and rotates same about an axis 15A. In the shown embodiment, the range of rotation is e.g. between 90° and 180°.

Counterstay bolt 15 is provided on a part of its circumference with a window 19 formed by a reduction of its cross-section. On both axial sides of window 19, the cross-section of the counterstay bolt 15 forms smooth circular and annular lands 20, 21, and said lands 20, 21 form cylindrical support faces for the spring lamella 14. According to FIGS. 1 and 2, window 19 is defined by a cross-sectional reduction of the counterstay bolt 15 which extends about 90° in the circumferential direction, has a convexly shaped bottom 22 and edge-shaped or rounded transitions 23 which extend into the circumferential surface of the bolt.

Weaving machine W includes a control CU for controlling the yarn insertion. Said control CU in turn is optionally connected via a further electronic control system C with the first actuator M1, i.e. the rotational drive for counterstay bolt 15, and also with the second actuator M2 forming a remotely controlled and actuated adjusting device E for the holder 10 or the force by which both braking elements B, B' are resiliently pressed against each other.

The force by which spring lamella 14 is pressed against counterstay bolt 15 can be varied by the second actuator M2. This can be done as well by means of the expediently common control system C. The control routine is customised such that an actuation of the second actuator M2 is made only when the first actuator M1 already has rotated the counterstay bolt 15 in the rotation position of FIG. 2 such that the braking effect is nullified, because the yarn then freely passes through window 19. In the position of FIG. 1, the braking effect is activated and is as strong as adjusted by the second actuator M2.

If it is necessary to vary the force determining the upcoming braking effect, this is carried out during the time period between two activated braking effect operation phases of the yarn brake 1, i.e. when the braking effect is nullified. This is made by selectively rotating holder 10 when counterstay bolt 15 is in the rotational position shown in FIG. 2, such that the yarn Y penetrates window 19 without any braking effect or with an extremely low braking effect only, while spring lamella 14 bears on lands 20, 21.

A variation of the force also could be adjusted by lateral displacement of holder 10 in carrier 2. In this case the second actuator M2 is designed as a lateral displacement drive of holder 10.

The window spring lamella yarn brake shown in FIGS. 1 and 2 is shown by way of example as a controlled yarn brake. The functional principle to vary the force by which two braking elements are pressed against each other during an insertion cycle is expedient for all yarn brake types in which the braking effect can be activated and nullified rapidly by a first actuator, such that the second actuator in operation phases of the nullified braking effect gains sufficient time to vary the force even during the insertion cycle. This means that the concept according to the invention also can be employed for disk brakes, band brakes or even for double lamella brakes, in which the first actuator rapidly switches the braking effect on and off while the second actuator varies the force determining the respective braking effect when the braking effect is switched off.

FIG. 1 indicates how control system C outputs commands i– or i+ to the first actuator M1 to nullify or to activate the braking effect, and outputs control orders (–) or (+) to the second actuator M2 when the force which determines the strength of the braking effect is to be varied. This expediently is made in association with predetermined angle values of the rotation of the weaving machine (shown schematically only) and as shown at CU by an angle symbol.

Figure 3:
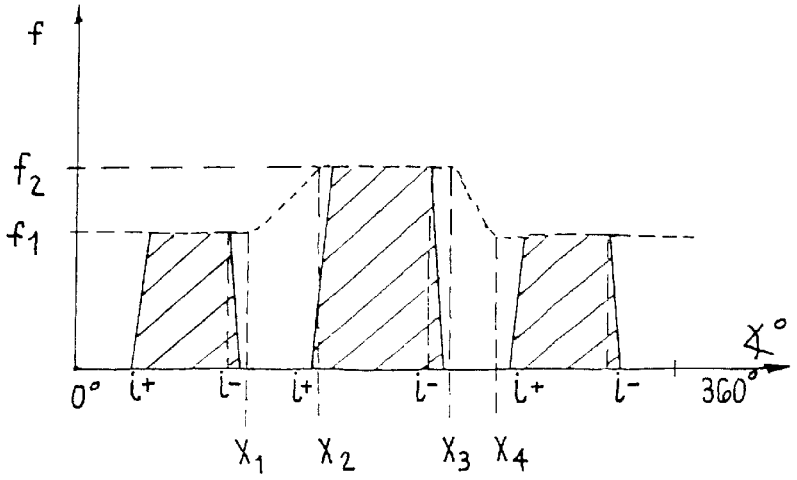
FIG. 3 is a diagram showing the operation behaviour of the yarn brake of FIGS. 1 and 2 employed at a rapier or gripper weaving machine.

FIG. 3 shows how a predetermined yarn tension profile is achieved by the controlled yarn brake 1 at a gripper weaving machine W. During an insertion cycle in the gripper weaving machine W, the yarn Y first is transported by a bringer gripper substantially to the middle of the weaving shed, is then handed over to the taker gripper, is drawn by the taker gripper entirely through the weaving shed, and finally is released by the taker gripper. The three hatched fields in the diagram of FIG. 3 (yarn tension f above the rotational angle from 0° to 360° of the weaving machine W) indicate operation phases with activated braking effect, while the intermediate unhatched fields indicate operation phases with nullified braking effect.

At the beginning of the insertion, the second actuator M2 adjusts a strength of a braking effect resulting in a yarn tension value fl. The first actuator M1 receives the command i– and has nullified the braking effect. The yarn brake 1 is in the position of FIG. 2 and does not yet brake.

At a predetermined angular position the first actuator M1 receives command i+. It rapidly activates the braking effect which starts essentially without any delay and as predetermined by the adjusted value fl. Said braking effect lasts over the first hatched field until command i– is output from the control system C to the first actuator M1. The first actuator M1 then practically abruptly nullifies the braking effect. Already at this point in time the second actuator M2 receives signal (+) and starts at angle position x1 to increase the force from value f1 to the value f2. Value f2 is reached at an angle position x2, or at the latest at the angle position at which the first actuator M1 again receives command i+ to enter the second hatched field again with actuated braking effect. The new strength of the braking effect now is determined by value f2 which lasts until the first actuator M1 at a further angle position receives the command i– and abruptly nullifies the braking effect. At angle position x3, the second actuator M2 adjusts the force value f2 again to value f1 (or another value), such that the value fl (or said other value) is present at an angle position x4. As soon as the first actuator M1 receives command i+ and activates the braking effect again, the braking effect occurs with value f1 in the third hatched field, until finally by the command i– output to the first actuator M1 the braking effect again will be nullified. Then the yarn brake 1 is ready for the next insertion cycle, beginning e.g. with value f1.

FIG. 3 shows that in a comparison to the switching rapidness of the first actuator M1 to activate and nullify the braking effect, the actuator M2 can by far use more time or a respective broader angular range than the first actuator M1 to vary the force. This allows a relatively optimum tension profile to be achieved for yarn Y without the necessity of involving considerable control efforts for the second actuator M2.

For a projectile weaving machine (not shown), another tension profile will be required than the tension profile shown in FIG. 3 for a gripper weaving machine. However, also in the case of projectile weft weaving machines there are operation phases during each insertion cycle or weaving machine cycle (at least one operation phase), during which the braking effect has to be nullified. Exactly then the force easily can be varied for the upcoming braking effect phase, which starts when the first actuator M1 again activates the braking effect.

It is expedient to carry out the variation of the force after first nullifying the braking effect and prior to a new activation of the braking effect. However, it is possible to somewhat superimpose both adjustments on each other in order to generate a tension profile for which the flat top regions of the hatched fields in FIG. 3 with the braking effect activated are less dominant or are not present at all.

In most cases of employing the yarn brake, it might be sufficient to adjust only two different force values by the second actuator M2 or to switch back and forth between two force values. However, it also is possible to let the second actuator M2 generate predetermined curved force profiles in a stepless manner and to superimpose said profiles to the curved profile generated by the first actuator M1. The adjustment of the respective force value can be carried out by the control system C1 alone. However, it is also possible to use the manual adjuster of the adjustment device to carry out predetermined basic adjustments. This means that the second actuator M2 either carries out all necessary adjustments as controlled from the control system, or that it only switches, while basic adjustments are carried out manually.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A controlled yarn brake for a gripper, rapier or projectile weaving machine, said yarn brake comprising two braking elements between which a yarn passes, said braking elements being resiliently pressed against one another by an adjustable force which determines the strength of a braking effect on the yarn, a first actuator for temporarily nullifying the braking effect on the yarn, and an adjustment device including a second actuator for adjusting the magnitude of the force when the braking effect is nullified by said first actuator, each said first and second actuator being connected to a control device.

2. The yarn brake of claim 1 wherein said second actuator comprises one of: an electric-type actuator; an electromagnetic-type actuator; a piezoelectric-type actuator; an electro-mechanical-type actuator; a pneumatic-type actuator; and a hydraulic-type actuator.

3. The yarn brake of claim 1 wherein said first and second actuators are connected to a common said control device.

4. The yarn brake of claim 1 wherein said two braking elements respectively comprise a spring lamella and a counterstay bolt, said bolt being rotatable by said first actuator and having at least one circumferentially-extending window for nullifying the braking effect in at least one rotary position of said bolt when said window faces said spring lamella, said adjusting device being connected to said second actuator and being disposed to hold said spring lamella.

5. The yarn brake of claim 4 wherein said spring lamella is mounted on a rotatably-supported holder of said adjustment device, a rotary position of said spring lamella being decisive in determining a value of the force, and said second actuator defining a rotary drive for said holder.

6. The yarn brake of claim 1 wherein said control device of said second actuator comprises a logical actuation inhibition assembly for said second actuator such that said second actuator is actuated only when said first actuator has nullified the braking effect.

7. The yarn brake of claim 1 wherein said second actuator comprises one of: a switching magnet; a permanent magnet motor; a rotary solenoid; a stepper motor; an LAT-electromotor; a pneumatic motor; and a hydraulic motor.

8. The yarn brake of claim 1 wherein said second actuator is configured so as to have a slower response behavior as compared to said first actuator.

9. The yarn brake of claim 1 wherein said two braking elements respectively comprise first and second generally parallel and spaced-apart rods, said first rod mounting thereon a plate-shaped spring having a first end portion connected to said first rod and a second end portion which resiliently bears against an outer surface of said second rod, wherein the yarn passes between said second end portion and said second rod.

10. The yarn brake of claim 9 wherein said outer surface of said second rod defines a recessed area which extends circumferentially about a portion of said second rod, said second rod being rotatably drivable by said first actuator into a nullifying position wherein said recessed area is in face-to-face and spaced-apart relation with said second end portion of said spring such that the yarn passes freely therebetween.

11. The yarn brake of claim 10 wherein the force is a contact force, said first rod is rotatably drivable by said second actuator which urges said second end portion of said spring in a direction towards or away from said outer surface of said second rod to adjust the contact force of said second end portion of said spring on said second rod.

12. The yarn brake of claim 11 wherein said outer surface of said second rod defines thereon a pair of vertically-spaced contact surfaces respectively disposed above and below said recessed area adjacent upper and lower portions of said second rod, said recessed area projecting inwardly beyond said contact surfaces and towards an axis of rotation of said second rod, said second end portion of said spring being supported on said contact surfaces when said second rod is in the nullifying position such that the yarn passes between said contact surfaces and through said recessed area which is spaced from said second end portion.

13. The yarn brake of claim 12 including a generally U-shaped carrier having a base and a pair of legs which are respectively cantilevered from opposite edge portions of said base, one said leg defining therein an entrance opening and through which the yarn enters and the other said leg defining therein a withdrawal opening which is aligned with said entrance opening through which the yarn exits, and said first and second actuators being mounted adjacent said base and said first and second rods projecting upwardly from said base and between the respective legs.

14. The yarn brake of claim 13 wherein said first and second actuators are connected to a common said control device.

15. A method for variably braking a yarn running through a controlled yarn brake in a gripper, rapier or projectile weaving machine during a yarn insertion cycle, the yarn brake having a pair of braking elements between which the yarn passes, said method comprising:

(1) resiliently pressing the braking elements against one another to effect a braking force on the yarn, the value of the force determining the strength of a braking effect on the yarn;

(2) nullifying the braking effect on the yarn with a first actuator;

(3) during a yarn insertion cycle, performing said step (2) at least once and thereafter re-activating the braking effect by performing said step (1); and (4) adjusting the magnitude of the braking force on the yarn with a second actuator during said step (2).

16. The method of claim 15 wherein a first of the braking elements is a rod and a second of the braking elements is a flexible spring having a first end portion fixed to a rotatable element driven by the second actuator and a second end portion which bears against said rod, the yarn passing between the second end portion and the rod, said step (4) including rotating the rotatable element to urge the second end portion of the spring in a direction towards or away from the rod to adjust a contact force of the second end portion on the rod and thereby adjust the magnitude of the braking force on the yarn.

17. The method of claim 16 wherein the rod defines therein a recessed area therein which extends circumferentially about a portion of the rod, and the rod is rotatably drivable by the first actuator, said step (2) including rotating the rod with the first actuator into a nullifying position wherein the recessed area is in face-to face and spaced-apart relation with the second end portion of the spring to allow the yarn to pass freely between the second end portion and the rod.

18. The method of claim 17 including controlling the first and second actuators with a common control device.

* * * * *